US007463251B2

(12) United States Patent
Giraldo et al.

(10) Patent No.: US 7,463,251 B2
(45) Date of Patent: Dec. 9, 2008

(54) DISPLAY DEVICE HAVING A SPARKLING EFFECT AND METHOD FOR DRIVING THE SAME

(75) Inventors: Andrea Giraldo, S'Hertogenbosch (NL); Mark T. Johnson, Veldhoven (NL); David A. Fish, Haywards Heath (GB)

(73) Assignee: TPO Displays Corp. (TW)

( * ) Notice: Subject to any disclaimer, the term of this patent is extended or adjusted under 35 U.S.C. 154(b) by 426 days.

(21) Appl. No.: 10/551,025

(22) PCT Filed: Mar. 23, 2004

(86) PCT No.: PCT/IB2004/000920

§ 371 (c)(1),
(2), (4) Date: Dec. 8, 2005

(87) PCT Pub. No.: WO2004/088625

PCT Pub. Date: Oct. 14, 2004

(65) Prior Publication Data

US 2006/0152450 A1 Jul. 13, 2006

(30) Foreign Application Priority Data

Apr. 1, 2003 (GB) ..... 0307476

(51) Int. Cl.
*G09G 3/30* (2006.01)

(52) U.S. Cl. ..... 345/204; 345/30; 345/76; 345/205; 345/207; 345/690

(58) Field of Classification Search ..... 345/30, 345/76, 204, 205, 207, 690
See application file for complete search history.

(56) References Cited

U.S. PATENT DOCUMENTS 6,298,175 B1 * 10/2001 Longacre et al. ..... 382/312
2002/0047550 A1 * 4/2002 Tanada ..... 315/155

(Continued)

FOREIGN PATENT DOCUMENTS

EP 0212679 A1 3/1987

(Continued)

*Primary Examiner*—Bipin Shalwala
*Assistant Examiner*—Vince E Kovalick
(74) *Attorney, Agent, or Firm*—Venable LLP; Raymond J. Ho

(57) ABSTRACT

The invention relates to a display device (6;6') comprising a display (2) having a plurality of display pixels (3;3') with light emitting elements (LED) and at least a first drive element (T1) and a second drive element (T2) for driving said light emitting elements (LED) in accordance with an analogue data signal, representing at least one frame in a range from low to high overall light emission states for said display (2). The display device (6;6') further comprises a display controller (10) having a data input (9) for the analogue data signal, a sensing unit (16) adapted to evaluate the overall light emission state of said frame and an output (13) for generating at least one sparkling signal for the one or more display pixels (3;3') having a high light emission state (18) exceeding a sensed low overall light emission state of said frame. The display controller (10) is arranged to individually control said first drive element (T1) and said second drive element (T2) by said sparkling signal such that said one or more display pixels (3;3') having said high light emission state are driven by at least one of said drive elements (T1,T2) in a sparkling light emission state (18';18") exceeding said high light emission state (18).

10 Claims, 11 Drawing Sheets

U.S. PATENT DOCUMENTS

| | | | | |
|---|---|---|---|---|
| 2002/0047555 | A1 | 4/2002 | Inukai | |
| 2002/0113867 | A1* | 8/2002 | Takigawa et al. | 348/51 |
| 2002/0180671 | A1* | 12/2002 | Inukai | 345/76 |
| 2002/0195964 | A1 | 12/2002 | Yumoto | |

FOREIGN PATENT DOCUMENTS

| | | | |
|---|---|---|---|
| EP | 0212679 | B1 | 3/1987 |
| EP | 1026655 | A1 | 9/2000 |
| WO | 03021343 | A1 | 3/2003 |

* cited by examiner

DISPLAY DEVICE HAVING A SPARKLING EFFECT AND METHOD FOR DRIVING THE SAME

The invention relates to a display device comprising a display controller and a display having a plurality of display pixels with light emitting elements and at least a first drive element and a second drive element for driving said light emitting elements.

Display devices employing light emitting elements deposited on or over a substrate are becoming increasingly popular. These light emitting elements may be light emitting diodes (LED's), incorporated in or forming display pixels that are arranged in a matrix of rows and columns. The materials employed in such LED's are suitable to generate light if a current is driven through these materials, such as particular polymeric (PLED) or organic (OLED) materials. Accordingly the LED's have to be arranged such that a flow of current can be driven through these light emitting materials. Typically passively and actively driven matrix displays are distinguished. For active matrix displays, the display pixels themselves comprise active circuitry such as one or more transistors.

In active matrix displays the variation of the parameters of the transistors is an important issue for e.g. the uniformity of the display. By operating the transistors at a reasonable high current the light emission of the LED's is less sensitive to variations in the threshold voltage of the transistors, the variation of which has been recognized as a major cause of non-uniformity of the display. U.S. Pat. No. 6,501,448 discloses an electroluminescent display device comprising a first transistor connected to a signal line and a second and third transistor, connected to the first transistor, for driving an organic luminescent element. The organic luminescent element is further connected to a power supply. When the organic luminescent element is selected by means of the first transistor, a voltage is applied to the gates of the second and third transistor such that an electrical current, in accordance with the voltage of the power supply, runs through the luminescent element, which then emits light. Such a display device reduces the effects of the variance in the characteristics of the driving transistors and suppresses the variance in luminance between the luminescent elements on the display when driven by the same current.

Although new display technologies rapidly emerge, people are still used to cathode ray tube (CRT) displays. One of the effects people are familiar with in CRT displays is the 'sparkling effect' or 'peak white', i.e. the effect of extra brightness for bright areas in otherwise dim frames. In a CRT display this effect occurs by the electron gun providing extra high current (and hence brightness) if only a part of the display shows a bright area. Indeed if the electron gun illuminates a large area current limitation of the electron gun reduces the brightness. However, if only a small area is bright in an otherwise dark scene, there is no limitation for the current. It is expected that people want the same effect for television employing the new display technologies. A problem associated with this prior art is that the display device is not adapted for achieving this sparkling effect.

It is an object of the invention to provide an improved display device, wherein the 'sparkling effect' can be obtained.

This object is achieved by providing a display device comprising:

a display having a plurality of display pixels with light emitting elements and at least a first drive element and a second drive element for driving said light emitting elements in accordance with an analogue data signal, representing at least one frame in a range from low to high overall light emission states for said display, and a display controller having a data input for said analogue data signal, a sensing unit adapted to evaluate said overall light emission state of said frame and an output for generating at least one sparkling signal for one or more display pixels having a high light emission state exceeding a sensed low overall light emission state of said frame, wherein said display controller is arranged to individually control said first drive element and said second drive element by said sparkling signal such that said one or more display pixels having said high light emission state are driven by at least one of said drive elements in a sparkling light emission state exceeding said high light emission state.

By providing such a sensing unit in the display controller and having individual control over the drive elements of the display pixels, the current through each individual light emitting element can be boosted to achieve the sparkling light emission state for the appropriate display pixels, i.e. the sparkling effect.

In an embodiment of the invention the display device comprises display pixels with selection means arranged to receive the sparkling signal and the display controller is arranged to control the drive elements via the selection means by the sparkling signal in order to select both the first drive element and the second drive element to obtain the sparkling light emission state. In this way the sparkling effect is achieved for selected display pixels by supplying current to the light emitting element from both drive elements.

In an embodiment of the invention the first drive element is connected to a first power line for driving the light emitting element in a first drive range, providing a low light emission state, and the second drive element is connected to a second power line for driving the light emitting element in a second drive range, providing the high light emission state. Preferably the display pixels comprise selection means arranged for receiving the sparkling signal and selecting the second drive element and the display controller is arranged to increase the power of the second power line to modify the second drive range to increase the current through the light emitting element. This embodiment allows that only the light emitting elements driven in the second drive range (the bright pixels, i.e. the pixels in the high light emission state) are driven to the sparkling light emission state, while the light emitting elements driven in the first emission state remain in the low light emission state.

In an embodiment of the invention the first drive element is adapted to drive the light emitting element in a first drive range and the second drive element is adapted to drive the light emitting element in a second drive range in accordance with the analogue data signal and the display controller is adapted to redistribute the analogue data signal over the first drive range and the second drive range for said one or more display pixels having a high light emission state when said sparkling signal is output. This processing of the analogue data input enables compensation of the gray level gap existing between the first drive range and the drive range applicable for the second drive element for light emitting elements in the sparkling light emission state. As a result image artifacts such as contouring are avoided.

In a preferred embodiment of the invention the display controller is adapted to transfer a part of said analogue data signal intended for said second drive element to said first drive element when outputting said sparkling signal and said first drive element is adapted to process said part of said analogue data signal. In this embodiment artifacts arising from a gap in the light emission states are avoided by making use of the redundancy between the first drive element and the second drive element as a result of which data processing by the display controller is less complex.

In the previous embodiments the drive elements may comprise transistors having different transistor channel dimensions and/or characteristics, such as the threshold voltage $V_T$ and the mobility μ of the charge carriers. Such transistors are able to accomplish the different drive ranges. The light emitting elements are preferably light emitting diodes (LEDs), such as organic LEDs (OLEDs).

The invention further relates to an electric device comprising a display device as described in the previous paragraphs. Such an electric device may relate to handheld devices such as a mobile phone, a Personal Digital Assistant (PDA) or a portable computer as well as to devices such as a Personal Computer, a television set or a display on e.g. a dashboard of a car. The invention is particularly suited for electric devices comprising large displays, in which displays the sparkling effect is better appreciated.

The invention also relates to a method for driving a display device having a display controller and a display with a plurality of display pixels with light emitting elements and at least a first drive element and a second drive element for driving said light emitting elements in accordance with an analogue data signal, representing at least one frame in a range from low to high overall light emission states for said display, comprising the steps of:

sensing said analogue data signal to evaluate the overall light emission state of said frame;

generating at least one sparkling signal for said one or more display pixels having a high light emission state exceeding a sensed low overall light emission state of said frame, such that said first drive element and said second drive element are individually controlled by said sparkling signal to drive said one or more display pixels having said high light emission state by at least one of said drive elements in a sparkling light emission state exceeding said high light emission state.

The invention also relates to a computer program for driving a display device, wherein the computer program at least comprises code-portions for executing the above mentioned method. Such a computer program may be stored in the display controller of the display device for executing the method according to the invention.

Non-prepublished European patent application. No. 02102679, ("Active matrix pixel cell with multiple drive transistors and method for driving such a pixel"), of the applicant describes a pixel cell comprising at least two drive elements and selecting means for providing a data signal to at least one of the drive elements, wherein each drive element is adapted to drive a current driven emissive element of the pixel cell in a different drive current range in response to a given data signal. The pixel cell allows for improvement of the non-uniformity of active matrix displays, also at low brightness levels, as a result of the individually selectable drive elements adapted to drive the emissive elements in different drive current ranges. The display according to the present invention may contain display pixels comprising selection means and different drive ranges for the drive elements as well, as a result of which the display device comprising the sparkling functionality may, in an embodiment of the invention, have a display with increased uniformity.

The invention will be further illustrated with reference to the attached drawings, which show preferred embodiments according to the invention. It will be understood that the device and method according to the invention are not in any way restricted to these specific and preferred embodiments.

Figure 1:
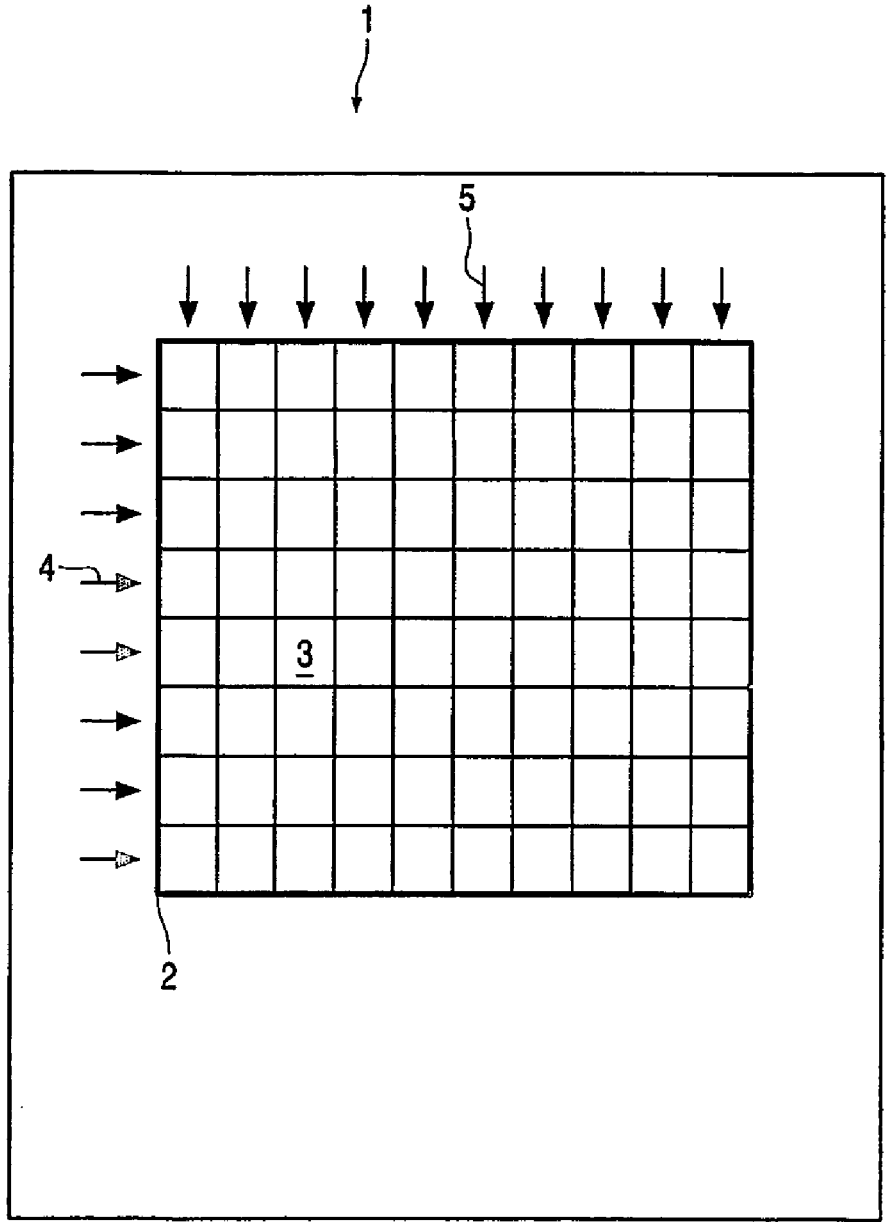
FIG. 1 shows an electric device comprising a display device according to an embodiment of the invention.
Figure 10:
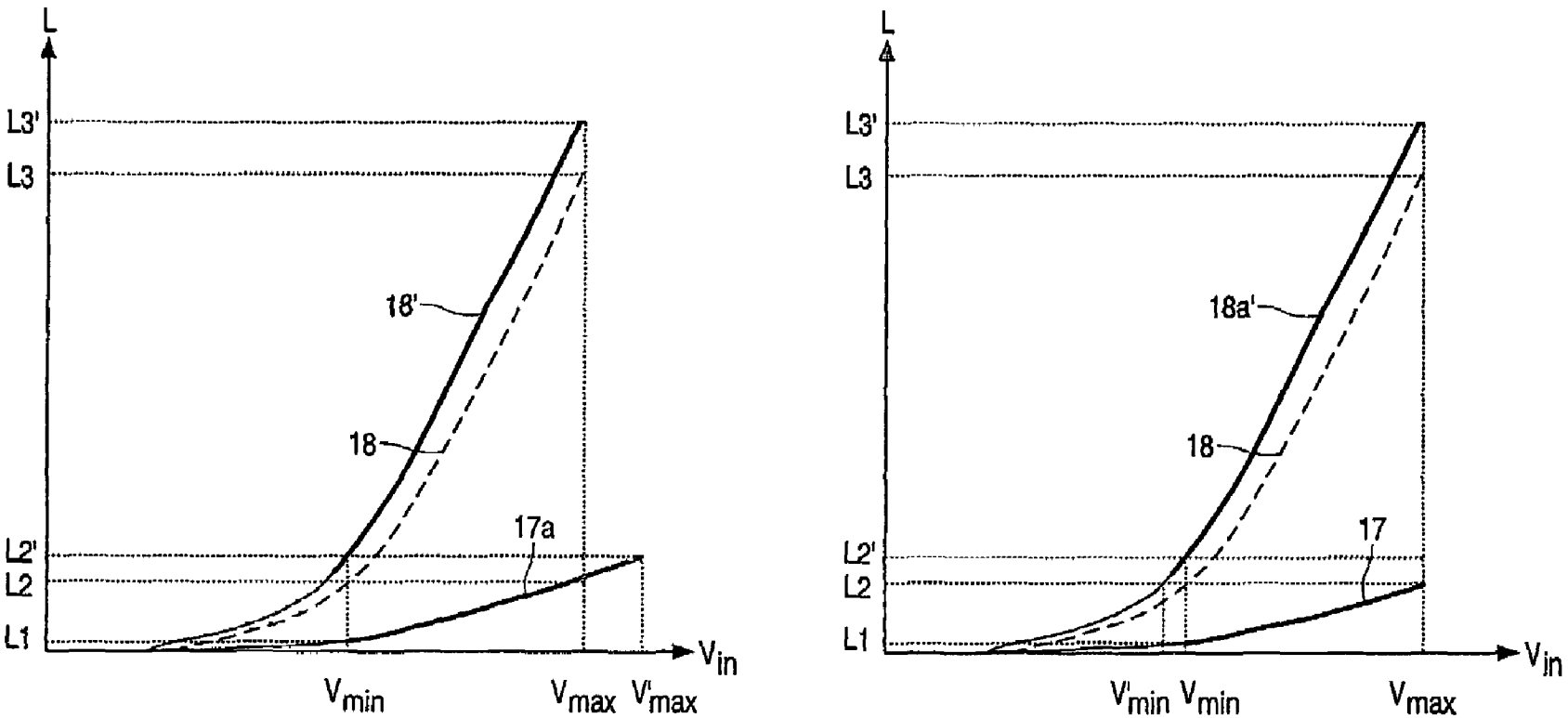
Figure 11:
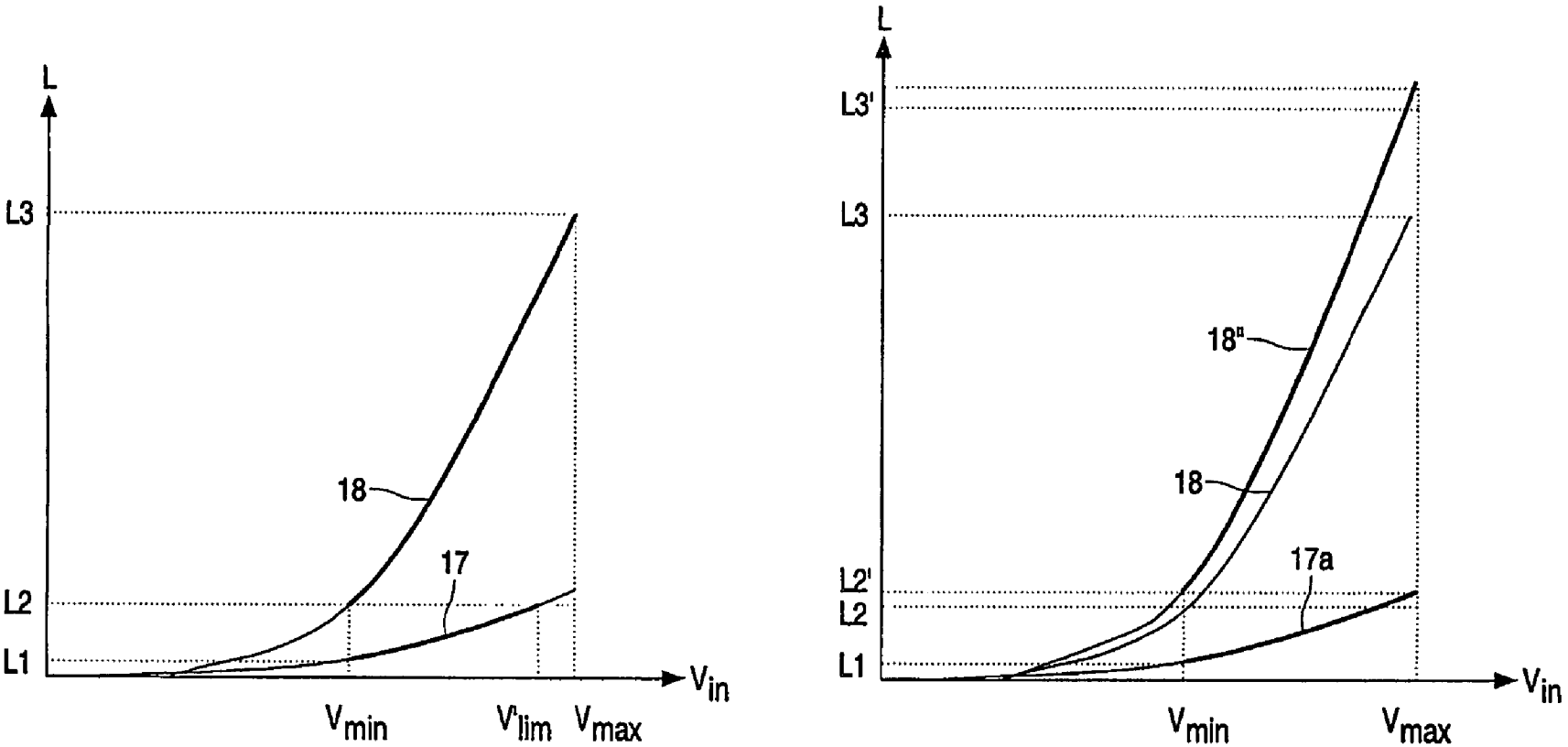

FIG. 10 displays L-V characteristics according to a first method of closing the gray level gap;

FIG. 11 displays L-V characteristics according to a second method for closing the gray level gap;

FIG. 1 shows an electric device 1 comprising an active matrix display 2 having a plurality of display pixels 3 arranged in a matrix of rows 4 and columns 5.

Figure 2:
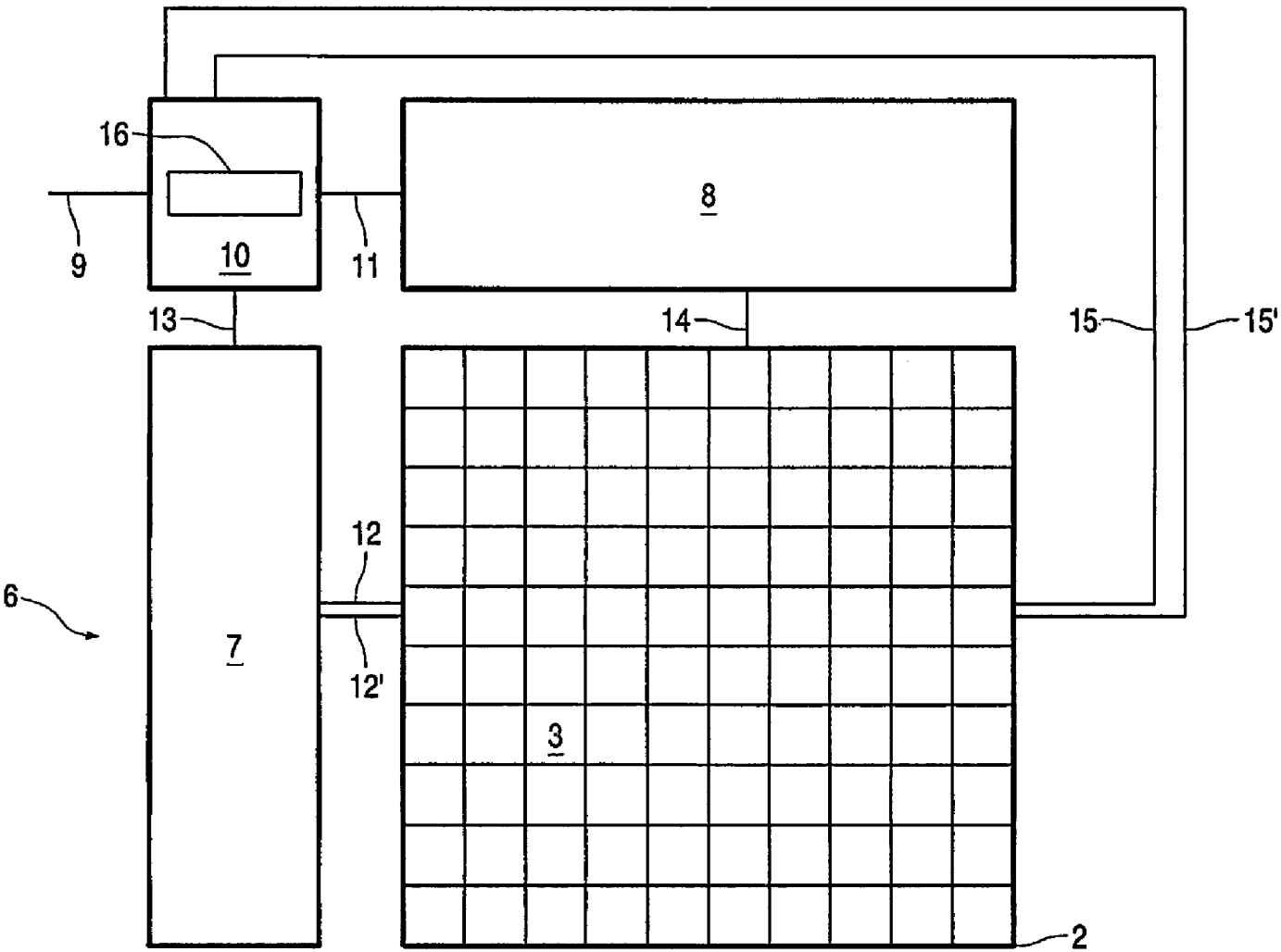
FIG. 2 shows a display device for an active matrix display of the electric device shown in FIG. 1.

FIG. 2 shows a schematical illustration of a display device 6, comprising the display 2 of the electric device 1 as shown in FIG. 1. The display 2 comprises a row selection circuit 7 and a data register 8. Information or data, such as (video) images, received via data input 9 and to be presented on the display 2 is input to a display controller 10, which information or data is subsequently transmitted to the appropriate parts of the data register 8 via line 11. Data are written to the display pixels 3 from the data register 8 via data lines 14. The is selection of the rows 4 of the display pixels 3 is performed by the row selection circuit 7 via selection lines 12 and 12', controlled by the display controller 10 via the output 13. Synchronization between selection of the display pixels 3 and writing of the data to the display pixels 3 is performed by the display controller 10. Moreover the display controller 10 controls the power supply of the display pixels 3 via power lines 15 and 15'. The display controller 10 further comprises a sensing unit 16 for evaluating the data signal received via the data input 9.

Figure 3:
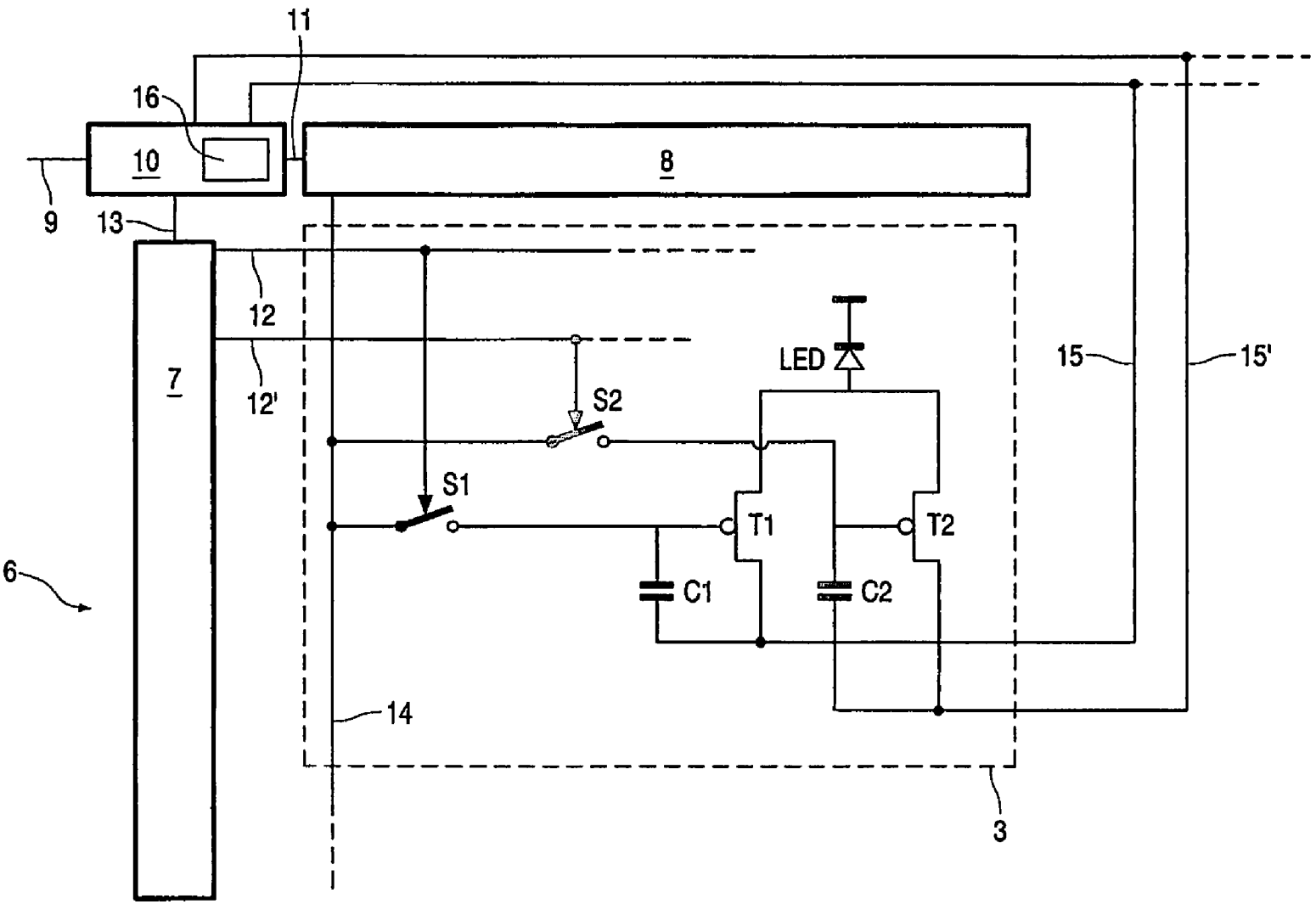
FIG. 3 shows a first example of a display pixel in a display device according to a first embodiment of the invention.

In FIG. 3 an exploded view of a single display pixel 3 is displayed, according to an embodiment of the invention, of the display device 6 as shown in FIG. 2. The display pixel 3 comprises a light emitting element, indicated as LED for light emitting diode, connected to a first drive element T1 and a second drive element T2 for driving the LED, which drive elements are in turn appropriately connected to a first storage element C1 and a second storage element C2. The first drive element T1 and the second drive element T2 may comprise transistors, whereas the storage elements may comprise capacitors. The display pixel 3 also comprises selection means, indicated in this embodiment by S1 and S2. Selection means S1, S2 are arranged to select the transistor T1 and the transistor T2 respectively, such that T1 and T2 can be selected individually by transmitting appropriate signals over the selection lines 12 and 12'. S1 and S2 may e.g. also comprise transistors. It is noted that a selection of T1 and T2 can be alternatively performed by using a single selection line 12 as described in the non-prepublished patent application 02102679 of the applicant. Selection of T1 and T2 can also be performed simultaneously for a single row employing two data lines 14. The drive elements T1 and T2 are further connected to a first power line 15 and a second power line 15' respectively, the power of which can be controlled via the display controller 10.

Figure 4:
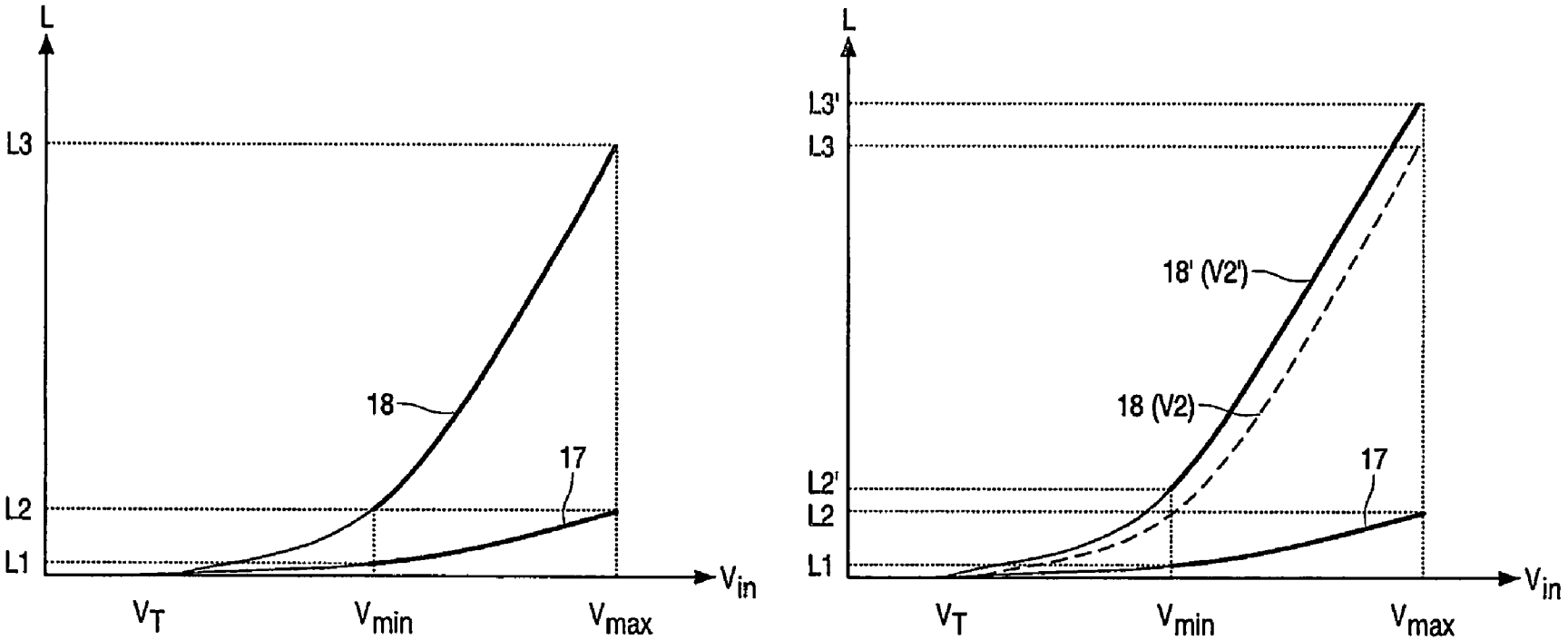
FIG. 4 shows L-V characteristics for the display pixel of FIG. 3.

The operation of the display device 6 shown in FIG. 2 comprising display pixels 3 as shown in FIG. 3 is explained in detail with reference to FIGS. 4-6. FIG. 4 displays characteristics of the LED before (left-hand characteristic) and after (right-hand characteristic) modification of the power over power supply line 15'. The vertical axis of the characteristics refer to the brightness L, that is linearly dependent on the current driven through or drive range of the LED, while the horizontal axis refer to the data voltages from the data register 8 fed to the gates of T1 and T2 in accordance with an analogue data signal to be displayed on the display 2.

The analogue data signal is input to the data input 9 of the display controller 10. The analogue data signal comprises frames to be displayed on the display 2. The display controller 10 provides signals via row selection circuit 7 to the display pixels 3. These signals are fed to the transistors T1 and T2 via lines 12 and 12' respectively to enable individual selection of T1 and T2. During selection of T1 a data voltage is written over data line 14 to the gate of T1 and during selection of T2, the data voltage is written over data line 14 to the gate of T2. Transistors T1 and T2 may have different transistor characteristics such as the transistor channel dimensions W or the threshold voltages or carrier mobilities allowing the transistors T1 and T2 to operate the LED in different drive ranges for the same power on power lines 15 and 15'.

In this case, the brightness L of the display pixel 3 can be described by the formula $L \sim W_1(V_{gs1}-V_{T1})^2+W_2(V_{gs2}-V_{T2})^2$, where $W_1$ and $W_2$ are the channel widths of the first and second transistors T1, T2, $V_{gs1}$, $V_{gs2}$ are the gate-to-source voltages of each transistor T1, T2 and $V_{T1}$, $V_{T2}$ are the threshold voltages of each transistor T1, T2. Assuming $W_1<W_2$, the transistor T1 with $W_1$ is operated in a first drive range for smaller brightness, while for higher brightness transistor T2 with width $W_2$ is operated in a second drive range. The gate-to-source voltage range is chosen such that the voltage $V_{gs}$ is away from the threshold voltages $V_{t1}$, $V_{t2}$ for both transistors T1, T2 to increase luminance uniformity over the display 2.

This is illustrated in FIG. 4 (left-hand characteristic), where the first transistor T1 is used to generate brightness levels between L1 and L2 (low light emission state corresponding to a first drive range) and the second transistor T2 is used to generate brightness levels between L2 and L3 (high light emission state corresponding to a second drive range). As is clear from FIG. 4, a brightness in the entire range between L1 and L3 can be obtained by switching between transistor T1 and transistor T2. In this voltage interval, the curve 17 represents the first transistor T1 characteristic and runs between L1 and L2, while the curve 18 represents the second transistor T2 characteristic and run between L2 and L3. As illustrated the range L1-L3 is obtained while staying away from the threshold voltage $V_T$ of the transistors T1 and T2, resulting in an improved uniformity of the display pixels 3 over the display 2.

The luminosity of the frames in the analogue data signal input at 9 may vary from very dim frames to very bright frames, i.e. the LEDs of the display pixels 3 of the display 2 may on average emit small to large amounts of light in accordance with the analogue data signal for a particular frame. The sensing unit 16 evaluates the overall light emission state of the frame of the analogue data signal. If the sensing unit 16 senses a frame with a low overall light emission state the display pixels 3 in the drive range L2-L3, i.e. the high light emission state, should emit more light in order to obtain the sparkling effect. In FIG. 3 this sparkling effect is achieved by providing a sparkling signal from the output 13 over the lines 12' to the selection means S1 and S2 in order to select the transistors T2 of those display pixels 3 and increasing the power fed to those transistors T2 via power line 15'.

The right-hand characteristic of FIG. 4 shows that for those display pixels 3 in the range L1-L2 (low light emission state 17) no additional light is generated, while those display pixels 3 originally in the high light emission state L2-L3 are now driven to a sparkling light emission state L2'-L3', indicated by 18', by increasing the voltage supplied over power line 15' to T2 from V2 to V2'. In this embodiment thus only those display pixels 3 in the high light emission state become brighter.

Figure 5:
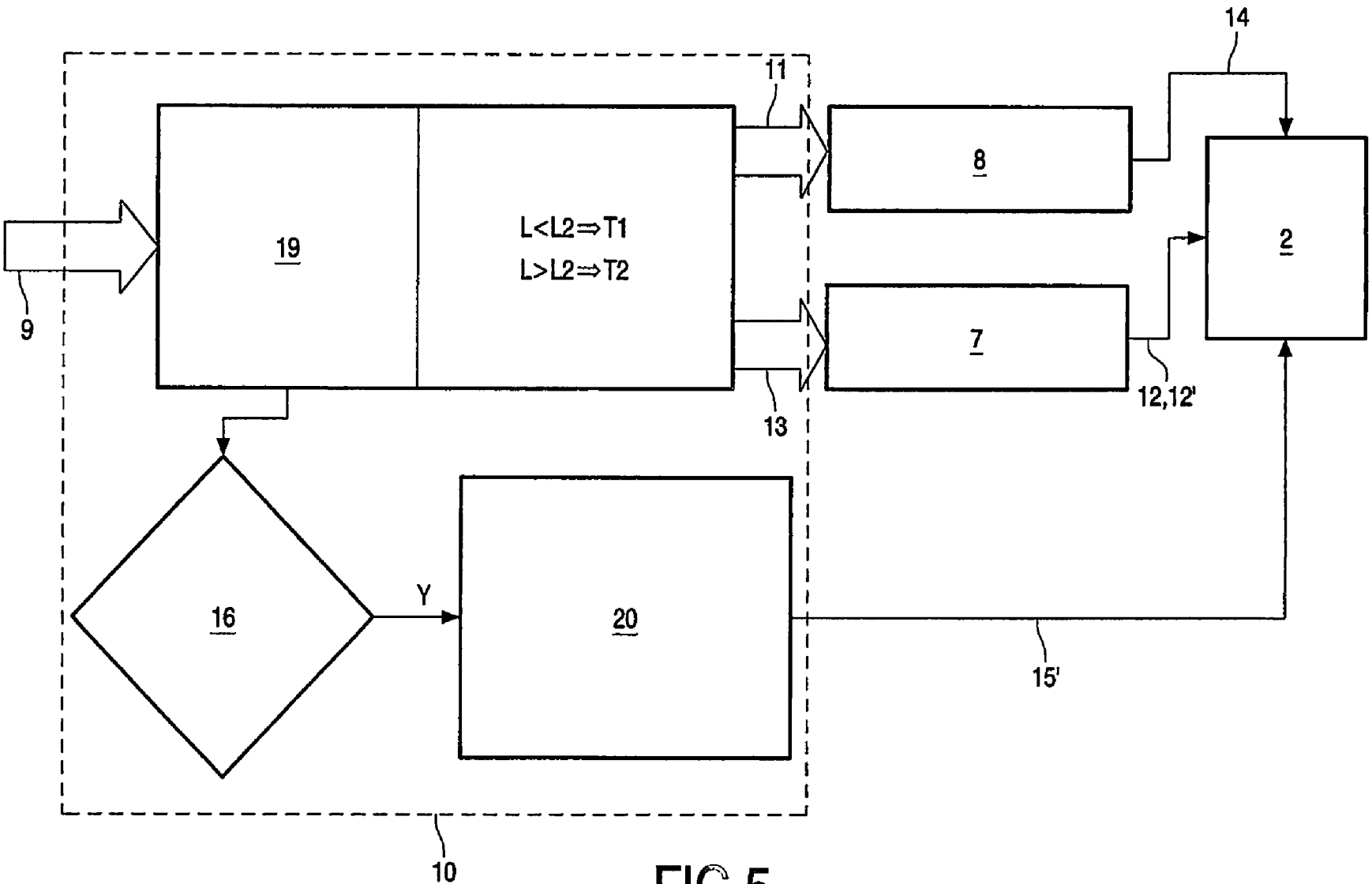
FIG. 5 shows an embodiment of a display controller for a display device shown in FIG. 3.
Figure 6:
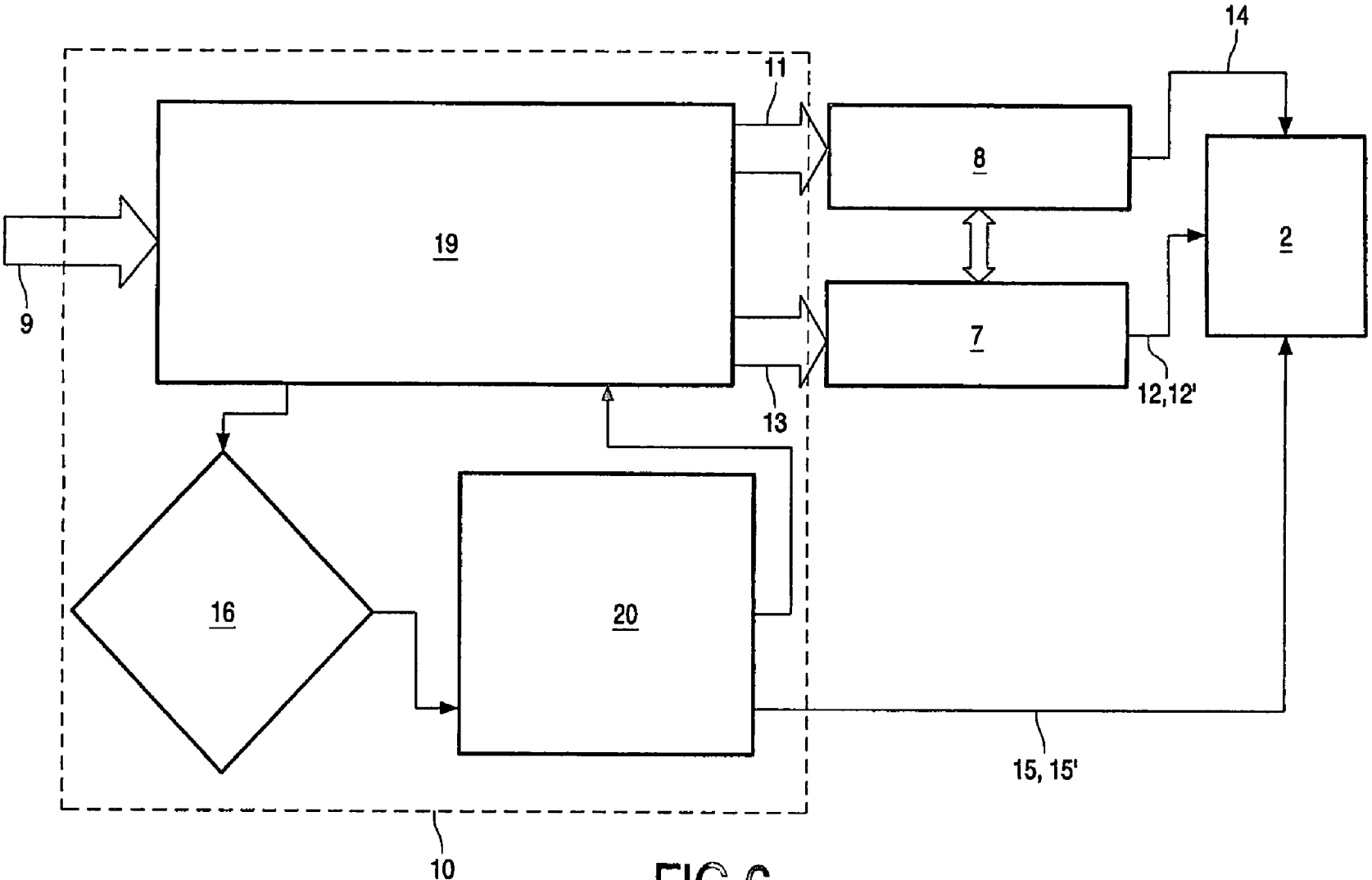
FIG. 6 shows an alternative embodiment of a display controller for a display device shown in FIG. 3.

FIGS. 5 and 6 show embodiments for the operation of the display controller 10. In FIG. 5 it is shown that the signal that enters the data input 9 is handled in a section 19. If the luminance L is found to be below L2, T1 is selected and otherwise T2. Moreover the data from section 19 is input to the sensing unit 16, wherein the average data signal (voltage or current) is measured as a measure of he average brightness of the frame. This average brightness can be compared with a pre-defined threshold for dark/bright frames to emit a sparkling signal from the section 20. This sparkling signal can be transmitted over the power line 15' to bring the display pixels in the second drive range in a sparkling light emission state. FIG. 6 shows an alternative embodiment, wherein the section 19 comprises some form of digital data processing, wherein the bright display pixels of a frame are localized, detected or sensed. In such a case the section 20 may both select the bright pixels boosting T2 via the row selection lines 12, 12' and increase the power of the power line 15' in order to obtain the sparkling effect.

Figure 7:
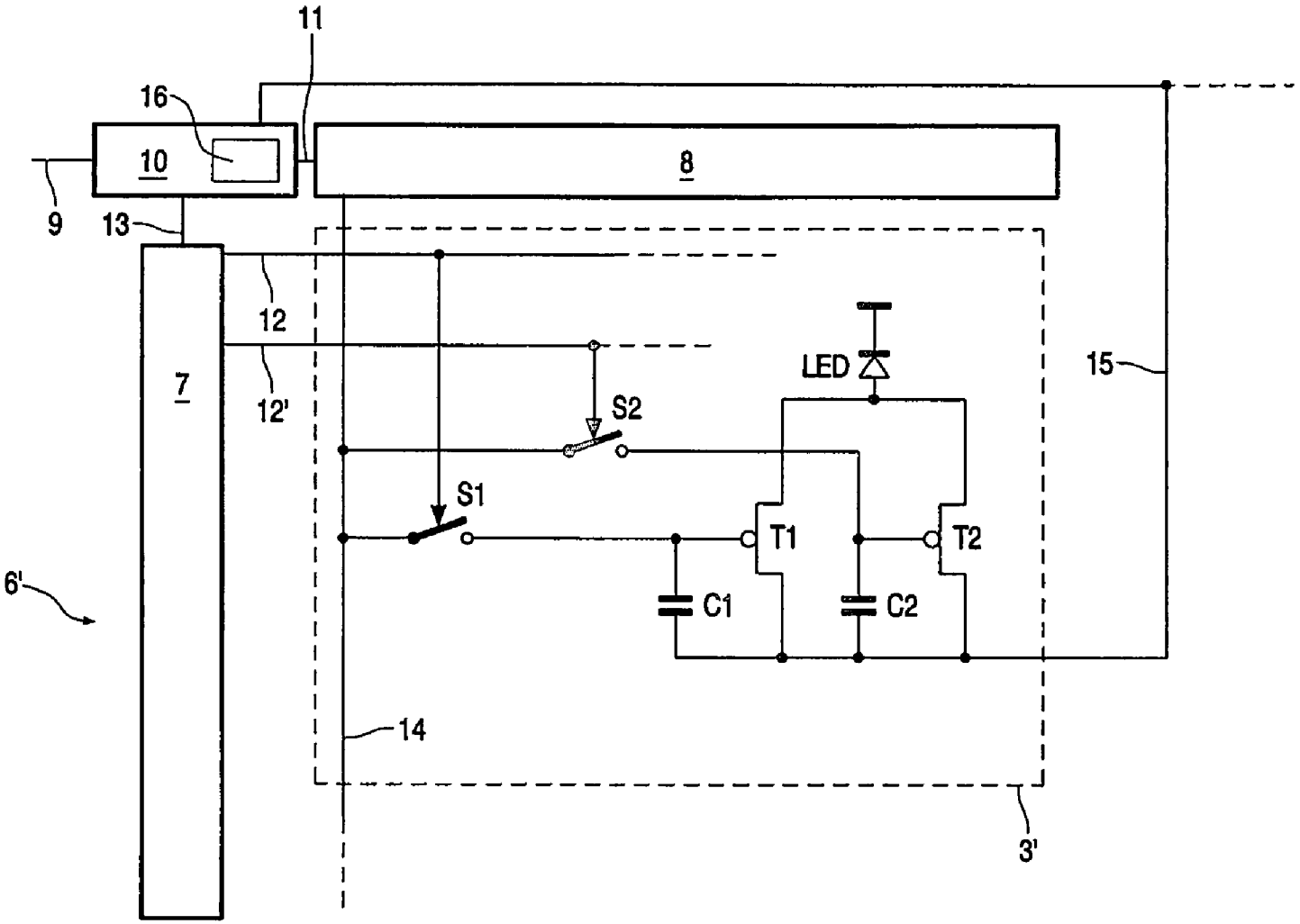
FIG. 7 shows a second example of a display pixel in a display device according to a second embodiment of the invention.

FIG. 7 shows a display device 6' according to an embodiment of the invention, having a display pixel 3'. Display device 6' and display pixel 3' differ from the display device 6 and the display pixel 3 shown in FIG. 3 in that only a single power supply line 15 is present such that the transistors T1 and T2 are both powered via this power line 15. The remaining elements of the display device 6' are similar to the elements of the display device 6 of FIG. 3 as indicated by the same reference numerals.

The sparkling effect is obtained by sensing the analogue data input of the display controller 10 using the sensing unit 16. If an overall dim frame is sensed a sparkling signal is fed from the output 13 to the selection means S1, S2 of the display pixels 3' having a high light emission state exceeding the overall light emission state for that dim frame. In response to the sparkling signal the selection means select both transistors T1, T2 of those display pixels 3' as a result of which current is fed to the LED from both transistors T1, T2. Therefore a sparkling light emission state exceeding the high light emission state of said display pixels 3' is obtained, i.e. a sparkling effect. This effect is illustrated in FIG. 8, wherein the sparkling light emission state is indicated with 18".

Figure 9:
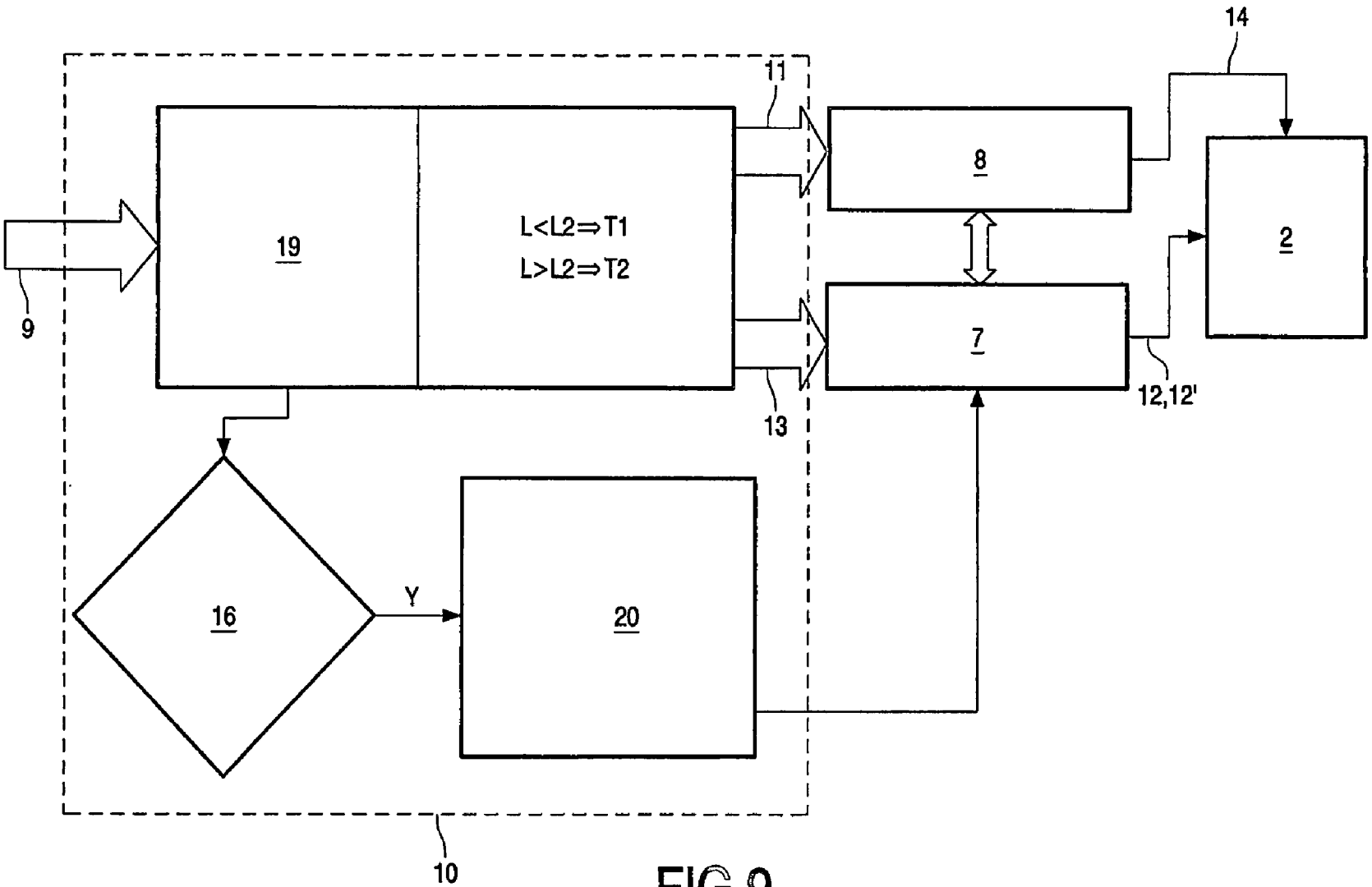
FIG. 9 shows an embodiment of a display controller for a display device shown in FIG. 7.

FIG. 9 shows a more detailed view of the display controller 10, comprising a data handling section 19 and a sparkling section 20, equivalent to FIG. 5. The sparkling signal however is of course fed to the row selection circuit 7 in order to select both transistors T1, T2 for the appropriate display pixels 3'.

Figure 8:
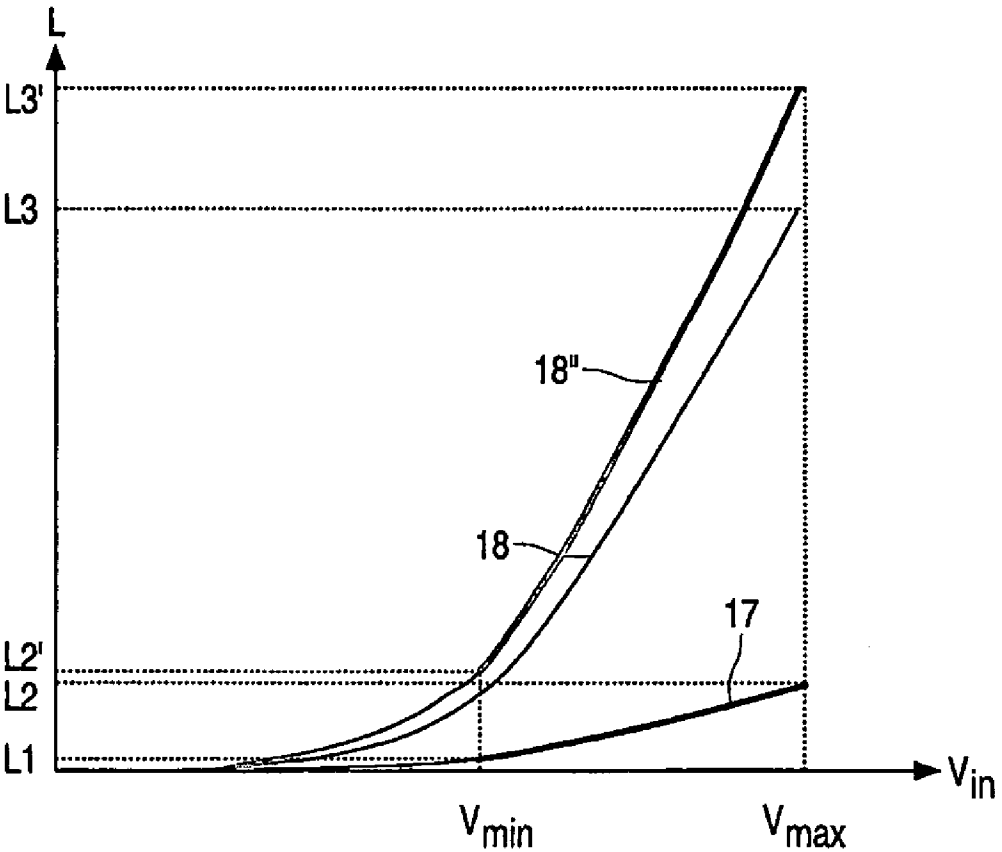
FIG. 8 shows a L-V characteristic for the display pixel of FIG. 7.

In comparing the characteristics of FIG. 4 (right-hand side) and FIG. 8, it can be observed that a gray level gap L2-L2' exists between the low light emission state 17 and the sparkling light emission state 18' and 18" respectively. The display device 6' employing the display pixels 3' is better in that this gap L2-L2' is smaller. The gap L2-L2' may result in image artifacts on the display 2 such as contouring.

In an embodiment of the invention the display controller 10 is adapted to redistribute the analogue data signal over the first range L1-L2 and the second drive range L2-L3 at least for those display pixels 3 in the high light emission state that receive the sparkling signal. FIG. 10 illustrates two options for such a redistribution. In the left-hand characteristic it can be observed that the gate voltage range of transistor T1 is extended to $V_{max}$' such that T1 is enabled to drive the LED up to L2'. In the right-hand characteristic the gate voltage range of transistor T2 is extended to gate voltages $V_{min}$' such that T2 is enabled to drive the LED down to L2. Both options require significant data processing by the display controller 10 to eliminate the gray level gap L2-L2', since redistribution of the data voltages from the data register 8, i.e. the gate voltages for T1 and T2, over the light emission states is required.

In a preferred embodiment of the invention the gray level gap L2-L2' is eliminated by using the redundancy between the drive ranges of the transistors T1 and T2 as illustrated in FIG. 11. In this embodiment the transistor T1 uses only a limited gate voltage range $V_{min}$-$V_{lim}$ of the available voltage $V_{min}$-$V_{max}$ for the first drive range L1-L2 if no sparkling signal is received (left-hand characteristic). If a sparkling signal is received (right-hand characteristic) the limited gate voltage range $V_{min}$-$V_{lim}$ is extended to an extended gate voltage, such that the gray level gap L2-L2' is filled. This is achieved by having the display controller transferring the input data from the analogue data signal for drive range L2-L2' from transistor T2 to transistor T1, i.e. the LEDs of the display pixels 3' emitting light in this range are driven by T1.

The invention is not restricted to the above described embodiments which can be varied in a number of ways within the scope of the claims. The invention is e.g. also applicable to current driven emissive displays with active matrix addressing. Moreover it is noted that the above described embodiments can be combined. In such a combined embodiment the display device 6 is adapted to both increase the power in the second power line 15' and to select both transistor T1 and T2

The invention claimed is:

1. Display device (6;6') comprising:

a display (2) having a plurality of display pixels (3;3') with light emitting elements (LED) and at least a first drive element (T1) and a second drive element (T2) for driving said light emitting elements (LED) in accordance with an analogue data signal, representing at least one frame in a range from low to high overall light emission states for said display (2), and a display controller (10) having a data input (9) for said analogue data signal, a sensing unit (16) adapted to evaluate the overall light emission state of said frame and an output (13) for generating at least one sparkling signal for one or more display pixels (3;3') having a high light emission state (18) exceeding a sensed low overall light emission state of said frame, wherein said display controller (10) is arranged to individually control said first drive element (T1) and said second drive element (T2) by said sparkling signal such that said one or more display pixels (3;3') having said high light emission state are driven by at least one of said drive elements (T1,T2) in a sparkling light emission state (18';18") exceeding said high light emission state (18).

2. Display device (6') according to claim 1, wherein said display pixels (3') comprise selection means (S1, S2) arranged to receive said sparkling signal and said display controller (10) is arranged to control said drive elements (T1, T2) via said selection means (S1, S2) by said sparkling signal in order to select both said first drive element (T1) and said second drive element (T2) to obtain said sparkling light emission state (18").

3. Display device (6) according to claim 1, wherein said first drive element (T1) is connected to a first power line (15) for driving said light emitting elements (LED) in a first drive range (17), providing a low light emission state, and said second drive element (T2) is connected to a second power line (15') for driving said light emitting element (LED) in a second drive range (18), providing said high light emission state.

4. Display device (6) according to claim 3, wherein said display pixels (3) comprise selection means (S1,S2) arranged for receiving said sparkling signal and selecting said second drive element (T2) and said display controller (10) is arranged to increase the power of said second power line (15') to modify said second drive range (18), providing said high light emission state, to said sparkling light emission state (18').

5. Display device (6) according to claim 1, wherein said first drive element (T1) is adapted to drive said light emitting element (LED) in a first drive range (17) and said second drive element (T2) is adapted to drive said light emitting elements (LED) in a second drive range (18) in accordance with said analogue data signal and said display controller (10) is adapted to redistribute said analogue data signal over said first drive range (17;17*a*) and said second drive range (18';18*a*') for said one or more display pixels (3) having a high light emission state when said sparkling signal is output.

6. Display device (6') according to claim 1, wherein said display controller (10) is adapted to transfer a part of said analogue data signal intended for said second drive element (T2) to said first drive element (T1) when outputting said sparkling signal and said first drive element (T1) is adapted to process said part of said analogue data signal.

7. Display device (6;6') according to claim 1, wherein said drive elements (T1,T2) comprise transistors having different transistor characteristics, such as transistor channel dimensions (W.sub.1;W.sub.2) and/or threshold voltages ($V_T$) and/or carrier mobilities (μ).

8. Display device (6;6') according to claim 1, wherein said light emitting elements (LED) are light emitting diodes.

9. Electric device (1) comprising a display device (6;6') according to claim 1.

10. Method for driving a display device (6;6') having a display controller (10) and a display (2) with a plurality of display pixels (3;3') with light emitting elements (LED) and at least a first drive element (T1) and a second drive element (T2) for driving said light emitting elements (LED) in accordance with an analogue data signal, representing at least one frame in a range from low to high overall light emission states for said display (2), comprising the steps of:

sensing said analogue data signal to evaluate the overall light emission state of said frame;

generating at least one sparkling signal for one or more display pixels (3;3') having a high light emission state (18) exceeding a sensed low overall light emission state of said frame, such that said first drive element (T1) and said second drive element (T2) are individually controlled by said sparkling signal to drive said one or more display pixels (3;3') having said high light emission state (18) by at least one of said drive elements (T1,T2) in a sparkling light emission state (18';18") exceeding said high light emission state (18).

* * * * *